United States Patent [19]

Mitin et al.

[11] 4,370,916

[45] Feb. 1, 1983

[54] PERCUSSIVE DEVICE

[76] Inventors: Leonid A. Mitin, Morskoi prospekt, 62, kv. 12; Vladislav V. Mitrofanov, Morskoi prospekt, 19, kv. 11; Vladimir Y. Fadeev, ulitsa Tereshkovoi, 6, kv. 180; Petr Y. Fadeev, ulitsa Russkaya, 25, kv. 204; Vladlen V. Korobkov, ulitsa Shljuzovaya, 12, kv. 17; Rim A. Kulagin, ulitsa Tereshkovoi, 2, kv. 22; Anatoly A. Vorozheikin, ulitsa Tereshkovoi, 24, kv. 8; Nikolai P. Ermilov, ulitsa Rossiiskaya, 12, kv. 56; Jury V. Smirnov, ulitsa Ekvatornaya, 1, kv. 170; Ivan A. Besedin, ulitsa Tereshkovoi, 12, kv. 91, all of Novosibirsk, U.S.S.R.

[21] Appl. No.: 81,915

[22] Filed: Oct. 4, 1979

[51] Int. Cl.[3] ..... F03C 1/04; F01L 19/02; F04B 1/00

[52] U.S. Cl. ..... 91/173; 91/189 R; 91/416; 91/417 R; 92/29; 92/146

[58] Field of Search ..... 91/22, 23, 27, 416, 91/417 R, 173, 189 R; 92/8, 10, 29, 146

[56] References Cited

U.S. PATENT DOCUMENTS

| | | | |
|---|---|---|---|
| Re. 27,244 | 12/1971 | Voitsekhovsky et al. | 60/54.5 HA |
| 1,430,359 | 9/1922 | Canion | 91/173 X |
| 1,536,413 | 5/1925 | Thrift | 92/146 X |
| 1,740,701 | 12/1929 | Osgood | 91/189 |
| 3,010,432 | 11/1961 | Robra et al. | 91/189 X |
| 3,557,663 | 1/1971 | Florjancic | 91/416 X |
| 3,601,987 | 8/1971 | Chermensky et al. | 60/54.5 HA |
| 3,601,988 | 8/1971 | Chermensky et al. | 60/54.5 HA |
| 3,603,210 | 9/1971 | Florjancic | 91/416 X |
| 3,605,916 | 9/1971 | Voitsekhovsky et al. | 173/139 |
| 4,066,189 | 1/1978 | Toyoaki et al. | 91/27 X |

FOREIGN PATENT DOCUMENTS

| | | | |
|---|---|---|---|
| 727963 | 2/1966 | Canada | 92/10 |
| 2526066 | 1/1976 | Fed. Rep. of Germany . | |
| 2658431 | 6/1978 | Fed. Rep. of Germany | 92/146 |
| 979646 | 4/1951 | France | 92/29 |
| 1340521 | 12/1973 | United Kingdom | 92/146 |
| 202835 | 11/1967 | U.S.S.R. . | |
| 287657 | 11/1972 | U.S.S.R. . | |

OTHER PUBLICATIONS

*Annales de Mines de Belgique,* No. 6, 6/75, p. 563.

*The Canadian and Metallurgical Bulletin,* vol. 68, No. 760, 8/75, p. 67.

*Primary Examiner*—Wm. Carter Reynolds

*Attorney, Agent, or Firm*—Fleit & Jacobson

[57] ABSTRACT

A percussive device for creating impact impulses, which device comprises a housing accommodating a striker. The striker has a tail portion located in a power cylinder which is joined to the housing and is filled with a fluid medium under pressure, said fluid medium operating the striker. Provision is made of an arresting mechanism which is kinematically connected to a drive designed to engage the striker for effecting its backward stroke in the process of which the fluid medium under pressure is compressed, storing potential energy. According to the invention, the striker backward stroke drive is constructed in the form of several hydraulic cylinders equidistantly spaced round the periphery of the housing. The rod of each of the hydraulic cylinders is connected to the striker arresting mechanism. One of the spaces in said hydraulic cylinders is constantly connected with the interior space of the power cylinder for the purpose of moving the arresting mechanism under the pressure of the fluid medium, whereas the other cylinder space is periodically put in communication with the pressure source, in order to effect the backward stroke of the arresting mechanism together with the striker, and with a pressure medium exhaust line.

5 Claims, 5 Drawing Figures

PERCUSSIVE DEVICE

BACKGROUND OF THE INVENTION

1. Field of the Invention

The present invention relates to power impulse systems designed to generate power impulses of certain frequency and intensity for acting upon the medium being worked and has particular reference to percussive devices for creating impact impulses of high power.

This invention can be used to advantage in mining applications, for example, in machines for non-explosive mining in highly abrasive hard rock and in machines for breaking oversize rock pieces.

It can also be used in construction applications in machines for breaking old building foundations and walls, stripping road concrete coating, preparing rock beds for dams and other hydroengineering constructions, etc.

Further, this invention can be used in machine building, in rapid-action forging and swage hammers, in cutting machines, etc.

2. Description of the Prior Art

Known in the art is a percussive device (U.S. Pat. No. 3,601,988) for creating pressure impulses by means of working fluid. Said device comprises a receiver filled with a compressed gas and a power cylinder in which is fitted an impact piston which divides the interior space of said power cylinder into two chambers one of which is connected with the receiver and the other with the source of the working fluid. The device also comprises a means for returning the impact piston. Said means is constructed in the form of a hydraulic cylinder with a piston which divides the interior of the hydraulic cylinder into two spaces, front and rear. The hydraulic cylinder piston end at the front space mounts an impact piston arresting mechanism designed for catching the impact piston by its tail portion which passes from the first chamber of the power cylinder through the rear wall thereof into the front space of the hydraulic cylinder. Said tail portion of the impact piston has a bevelled surface on the end thereof. A groove with another bevelled surface is provided nearby. The impact piston arresting mechanism comprises a cup-shaped projection on the hydraulic cylinder piston. The wall of said projection has holes to accomodate cams designed for interaction with the tail portion of the impact piston during its initiating stroke and is provided with slots for passage of a crossmember. A barrel put on the cup-shaped projection has holes for sinking the cams at the release of the impact piston. The barrel is connected by means of said crossmember with a small piston movably mounted in a hole provided in the hydraulic cylinder piston. Provided on the back wall of the hydraulic cylinder is a stop designed for interaction with the small piston at the release of the impact piston.

At the initial stage of operation the impact piston is in the front position. When the pressure medium is fed into the rear space of the hydraulic cylinder, it moves the piston together with the arresting mechanism forward until the tail portion of the impact piston enters the cup-shaped projection, whereby the cams are caused to engage the groove in the impact piston tail portion. Thereafter the rear space of the hydraulic cylinder is put in communication with the outlet line, whereas the front space of said cylinder is connected with the source of pressure. The feed of the pressure medium into the front space of the hydraulic cylinder causes, first of all, movement of the small piston and the barrel, which is connected thereto by means of the crossmember, towards the back wall of the hydraulic cylinder, whereby the cams are locked in the engaged position. Then the hydraulic cylinder piston is caused to move, carrying therewith the impact piston by means of the cams interacting with the bevelled surface of the groove in the impact piston tail portion, forcing out the gas from the first chamber of the power cylinder into the receiver and compressing the gas still further. Thus the initiating stroke of the impact piston is completed. At the same time the working fluid is fed into the second chamber of the power cylinder. At the end of the initiating stroke of the impact piston the small piston is stopped by interaction with the stop on the back wall of the hydraulic cylinder, whereas the piston of the hydraulic cylinders continues moving. This results in shifting the barrel into the front position is relation to the cup-shaped projection, the barrel holes locating opposite the cams. By the action of the bevelled surface of the groove in the tail portion of the impact piston the cams are disengaged from said groove, thereby releasing the impact piston. The compressed gas in the first chamber of the power cylinder and in the receiver causes the impact piston to accelerate on its forward stroke, creating an impact pressure impulse in the working fluid. This completes the working stroke of the impact piston, whereupon the impact piston stops and the working cycle can be repeated.

In the percussive device under consideration, the means for returning the impact piston calls for expending energy of the pressure source on moving the hydraulic cylinder piston in both directions described herein, which causes need for employing substantially complicated arrangements for controlling the flow of the pressure medium. Furthermore, the disengagement of the cams from the impact piston tail portion is effected under load, which causes heavy wear on all the elements taking part in the disengagement process. The abovementioned disadvantages of the device under consideration substantially reduce its dependability.

Also known in the art is a percussive device (U.S.S.R. Inventor's certificate No. 202835) referred to as an impulse water jet. Said device has a barrel with a charging chamber for liquid under high pressure and is provided with a conical nozzle through which the liquid issues at a high velocity and which bounds the volume of the charging chamber at the front. A light piston is located in the charging chamber at the rear end thereof. Said piston separates the charging chamber from the interior space of a hydraulic cylinder with a heavy piston. Said heavy piston is adapted to reciprocate in the hydraulic cylinder and divides the interior space of the same into two spaces one of which is in constant communication with the atmosphere and the other is filled with oil.

The rear end of the light piston has a collet-type engagement arrangement designed for engagement of the light piston with the purpose of it being moved into the initial position by the heavy piston moving in the hydraulic cylinder. Provision is made of a receiver which adjoins said other space of the hydraulic cylinder and is separated therefrom by a partition having holes for passage of oil. The receiver serves the purpose of charging the water jet with a compressed gas and accomodates a piston with a drive mechanism rod passing therethrough. The end of said rod entering the other space of the hydraulic cylinder mounts an engagement arrangement which consists of a cup, an annular valve designed to discharge oil from the cup when engaging the heavy piston and admit oil into the cup when disengaging the heavy piston, an actuating spring, and a valve seat. To impart a reciprocating motion to the rod of the drive mechanism, use is made of the drive mechanism itself which may take the form of a crank gear or a hydraulic drive.

Preparatory to operation, the water jet is fed with water, the receiver is filled with a gas and the required oil pressure is built up in the other space of the hydraulic cylinder.

After the water jet is filled up with a gas and oil, and a liquid supply line is connected to the charging chamber, the heavy piston assumes the forward position, whereas the drive mechanism rod with the engagement arrangement takes the rearmost position. The drive mechanism moves said rod towards the heavy piston and the cup moves thereonto and encloses the oil in its interior (the inside cylindrical surface of the cup and the mating surface of the heavy piston are sealed), forcing it during further movement out of the cup interior into the other space of the hydraulic cylinder through a hole in the drive mechanism rod and the annular valve. When the cup interior is fully emptied of the oil, the activating spring expands and closes the valve onto the seat. During the return stroke of the drive mechanism rod the cup begins leaving the heavy piston, whereby the volume of the cup interior is increased and, as a result, the pressure inside the cup drops sharply and the oil pressure in the other space of the hydraulic cylinder becomes considerably lower. At the same time increase takes place in the forces which cause the heavy piston to follow the engagement arrangement and said heavy piston moves after the rod of the drive mechanism. The light piston, which is engaged to the heavy piston by means of the collet-type arrangement, moves therewith. On reaching a stop in the charging chamber, the light piston stops, the charging chamber is filled with liquid, and the heavy piston, on disengaging the collet, continues moving after the drive mechanism rod, forcing the oil out of the other space in the hydraulic cylinder through the holed partition into the receiver, whereby the receiver piston is moved and the gas in the receiver compressed.

When the drive mechanism rod approaches the rearmost position, the annular valve comes up against the holed partition and stops, the actuating spring becomes compressed and the annular valve becomes unseated, permitting the oil to rush from the other space in the hydraulic cylinder into the cup.

The energy stored in the compressed gas accelerates the piston in the receiver and the latter moves the oil, causing the heavy piston to move. The heavy piston accelerates, passes through the light piston collet and strikes the end of the light piston. The light piston transmits the energy to the liquid, the conical nozzle forms this liquid into a jet and the latter issues into the atmosphere at a high velocity.

After the jet is shot, all the mechanisms return into the initial position and the cycle is repeated.

The water jet under consideration has a substantially complicated construction with a large number of sealing elements and, like the previously described device, requires the use of a double-acting drive which is also substantially complicated.

All the disadvantages mentioned above adversely affect the dependability of the water jet.

Also known in the art is a percussive device referred to as a hydraulic hammer for breaking rock (U.S.S.R. Inventor's certificate No. 287657). Said device comprises a power cylinder which accomodates a piston with a rod. Said piston divides the interior space of the cylinder into two spaces, viz. a gas space and a liquid space. The device also comprises a hammer connected to said piston by means of said rod and adapted to reciprocate in guides provided with pneumatic dampers, a receiver designed for holding a compressed gas and connected with the gas space of the power cylinder, and a shutter located on the outside of the power cylinder and designed for opening large-section ports arranged to connect the liquid space of the power cylinder with the atmosphere. The front end of the hammer has a seat to receive a cylindrical tool for breaking rock. The receiver is made in the form of several pipes interconnected by the front and rear heads of the power cylinder and forming, in conjunction with said cylinder heads, the framework of the hydraulic hammer.

After the device is prepared for operation by charging the receiver with a gas to the required pressure, the piston, the hammer and the rod interconnecting these two parts are in the extreme forward position. When liquid is fed under pressure into the liquid space of the power cylinder, the piston and the hammer connected thereto by means of the rod move back, away from the rock, still further compressing the gas in the gas space of the power cylinder and in the receiver. After the movable system including the piston, the rod and the hammer reaches the rearmost position (when the hammer tool is at the maximum distance from the rock), the shutter moves on the power cylinder and opens the ports. Under the action of the compressed gas said system moves, accelerating, towards the rock, whereas the liquid is forced by the piston from the liquid space of the power cylinder through the ports into the atmosphere. The tool strikes the rock and the hammer stops. At this instant the shutter returns into the intial position, closes the power cylinder ports and the process is repeated.

In the device under consideration, the whole movable system, including the hammer, tool, piston, rod and a number of fastening, sealing and dampening elements, takes part in a blow, which adversely affects their working condition and, consequently, reduces the dependability of said device.

SUMMARY OF THE INVENTION

It is an object of the present invention to increase the dependability of a percussive device.

It is a further object of the present invention to provide a percussive device of increased dependability, in which device the drive of the striker backward stroke will be of comparatively simple construction providing for substantial decrease in the working load on the elements of the device.

According to the invention, there is provided a percussive device for creating impact impulses acting on the medium being worked, which device comprises a housing accomodating a striker adapted to reciprocate and transmit impact impulses to the medium being worked, said striker having a tail portion located in a power cylinder which is joined to said housing and is filled with a fluid medium under pressure, which fluid medium is designed to store potential energy in the process of its compression during the backward stroke of said striker and to act upon the end of the striker tail portion during the forward stroke of said striker, thereby being provided an arresting mechanism designed for interacting with the striker during its backward stroke and kinematically connected with a striker backward stroke drive mounted on the housing.

Said striker backward stroke drive is constructed in the form of several hydraulic cylinders equidistantly spaced round the housing periphery with respect to the striker axis, each of said hydraulic cylinders having a ram connected to the striker arresting mechanism and being arranged so that one cylinder space is constantly connected or in communication with the interior space of the power cylinder for the purpose of moving the arresting mechanism into engagement with the striker under the pressure of the fluid medium, whereas the other cylinder space is periodically put in communication with the pressure source, in order to effect the backward stroke of the arresting mechanism together with the striker, and with a pressure medium exhaust line.

This embodiment of the striker arresting mechanism drive simplifies the construction thereof as well as the construction of the arrangements for controlling the flow of the pressure medium, whereby the operation of the device constituting the present invention is rendered more dependable.

It is desirable that in the percussive device constituting the present invention the striker arresting mechanism be located inside the power cylinder for interaction with the striker tail portion and one of said spaces of each hydraulic cylinder be combined with the interior space of the power cylinder so that the rams of the hydraulic cylinders pass into the power cylinder through its wall adjoining the housing.

This constructional arrangement makes it possible to reduce the number of sealing elements, still further simplify the construction of the striker arresting mechanism drive, reduce the overall mass of the device and render the parts thereof more adaptable for manufacture.

In machines wherein the striker has to be securely kept in the start position for a long time (for example, in devices for breaking oversize rock pieces), it is desirable that the arresting mechanism be constructed in the form of a slide movable in relation to the striker arranged to pass therethrough, said slide having at least one spring-loaded detent designed to engage the striker on the backward stroke thereof, and the striker tail portion having an arrangement for arresting and releasing the striker at the end of the backward stroke, the detent being provided with means for sinking it and for locking same when arresting the striker at the end of its backward stroke.

This embodiment of the arresting mechanism makes it possible to infinitely retain the striker in the start position for convenient aiming of the device as well as to release the striker without imposing load on the detent or detents, which materially increases the dependability of the device.

In machines operating at high blow frequency (for example, in hammers for mining work in hard rock), it is desirable that the arresting mechanism should have a cup-shaped cavity and the striker tail portion be provided with a projection forming a piston adapted to enter said cup-shaped cavity and interact with the surface thereof for the purpose of effecting the backward stroke of the striker, said arresting mechanism being provided with a valve designed for discharging the fluid medium from the cup-shaped cavity at the instant of arresting the striker and admitting same into the cup-shaped cavity when releasing the striker.

This embodiment of the arresting mechanism provides for a high rate of the striker arresting and releasing action, features few parts and ensures high operating dependability.

Now the invention will be described in detail with reference to the accompanying drawing:

DETAILED DESCRIPTION OF PREFERRED EMBODIMENTS OF THE INVENTION

Figure 1:
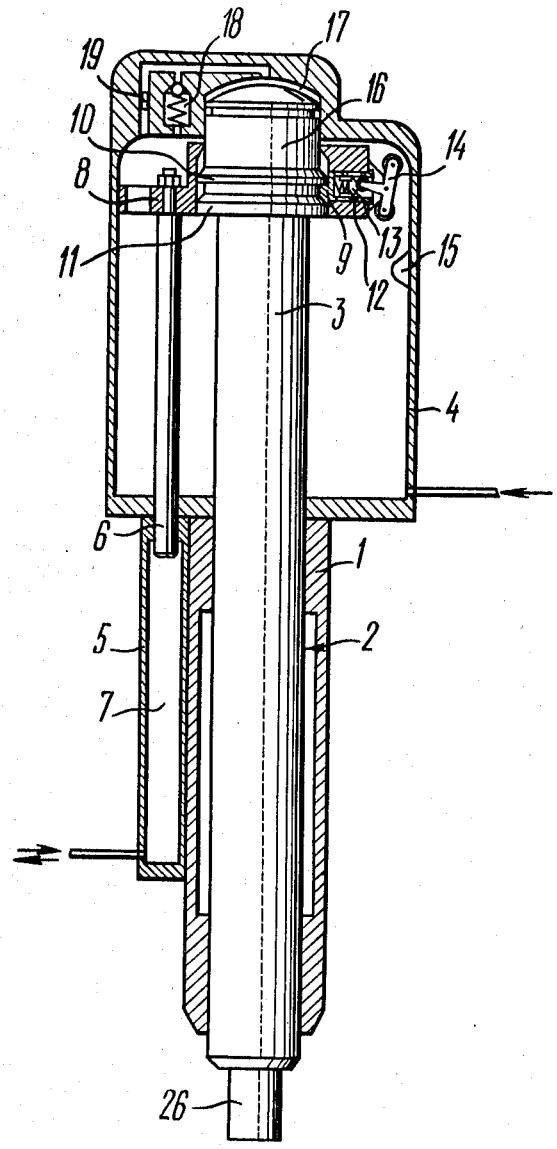
FIG. 1 shows one of the embodiments of the device according to the invention, wherein the striker arresting mechanism is located inside the power cylinder and constructed in the form of a slide having a spring-loaded detent.

Referring to FIG. 1, the percussive device constituting the present invention comprises a housing 1 accomodating a striker 2 which is adapted to reciprocate therein and has a tail portion 3 located in a power cylinder 4 mounted on the housing 1 and filled with a fluid medium under pressure, which fluid medium is designed to store potential energy in the process of its compression during the backward stroke of the striker 2 and to act upon the end of the striker tail portion 3 during the forward stroke of the striker. Several hydraulic cylinders 5 are equidistantly spaced round the periphery of the housing 1 with respect to the axis of the striker 2. Each of the hydraulic cylinders 5 has a rod 6 (FIG. 1) connected to the arresting mechanism. One of the spaces in each of the hydraulic cylinders 5 is in communication or combined with the interior space of the power cylinder 4, that is, the cylinder 5 has an opening or bore formed therein that is aligned with a similar opening or bore formed in a wall of the cylinder 4. The other space 7 of each cylinder 5 is periodically put in communication with the pressure source, in order to effect the backward stroke of the arresting mechanism together with the striker 2, and with a pressure medium exhaust line. The pressure source and the pressure medium exhaust line are not shown in the accompanying drawings.

The described construction forms an arresting mechanism drive described below and materially simplifies said drive, thereby increasing the dependability of the device. Furthermore, the number of pressure medium lines is decreased, which simplifies the flow control equipment related to the dependability of operation of the device.

The embodiment of the invention shown in FIG. 1 comprises an arresting mechanism with a slide 8 which is connected to the rods 6 of the hydraulic cylinders 5 and has a detent 9 designed for arresting the striker 2 on the initiating stroke thereof, for which purpose the striker is provided with a projection 10. The detent 9 is provided with a means for sinking it into the slide, which means is essentially a projection 11 on the tail portion 3 of the striker 2. The detent 9 is also provided with a means for locking it when arresting the striker 2. Said means consists of a spring 12, a retainer 13, a triple-arm lever 14 with rollers, and a cam 15 mounted on the wall of the power cylinder 4. The tail portion 3 of the striker 2 is provided with a means for retaining the striker at the end of the backward stroke. In this embodiment, this means is constructed in the form of a projection forming a piston 16 on the striker tail portion 3 and a cavity 17 whose cylindrical surface is equal in diameter to the piston 16. Said cavity 17 is provided in the thickened head of the power cylinder 4 and is arranged to communicate with the power cylinder interior space through a check valve 18 designed to compress and then discharge the fluid medium from the cavity 17 when said space is closed by the piston 16 at the end of the backward stroke of the striker 2, and through a duct with a throttling element 19, which duct is parallel to said valve 18 and is designed to admit the fluid medium into the cavity 17 when the striker 2 is released at the end of its backward stroke.

It is to be understood that the embodiment of the detent for arresting the striker on the backward stroke thereof and of the detent sinking means in the form of the projection 11 as well as of the detent locking means (the spring 12, retainer 13, triple-arm lever 14, cam 15) will be constructed as broadly as the art permits, other embodiments being possible.

The arrangement described above can retain the striker 2 in the start position infinitely for accurate aiming of the device, which increases the dependability of the device in some operations (for example, in braking oversize rock pieces).

Figure 2:
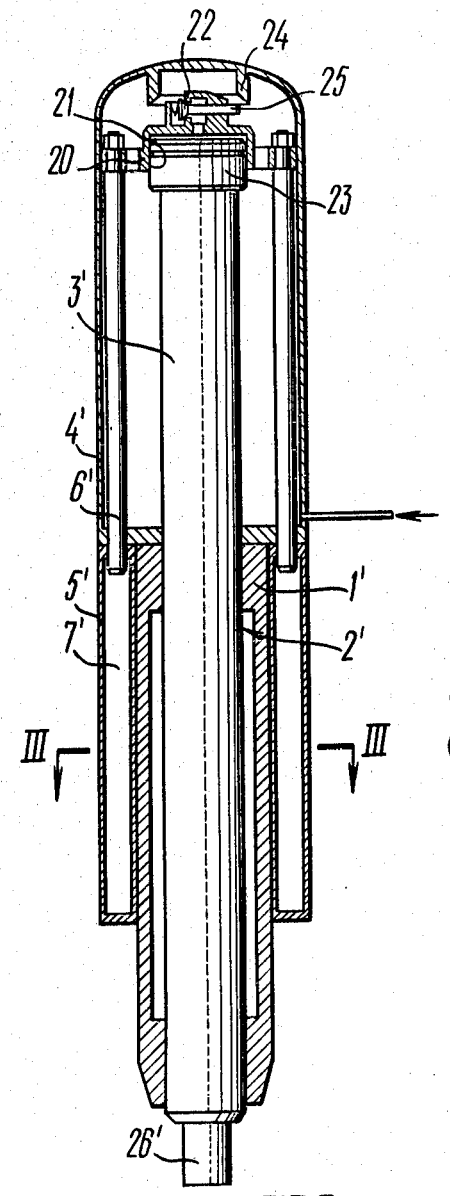
FIG. 2 shows another embodiment of the device according to the invention, wherein the striker arresting mechanism is also located inside the power cylinder, but is provided with a cup-shaped cavity, whereas the striker tail portion is provided with a projection forming a piston.
Figure 3:
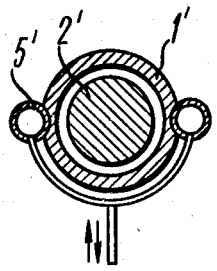
FIG. 3 is a cross-sectional view taken generally on the plane of line III—III of the device in FIG. 2 taken through the other space of the hydraulic cylinders.

The embodiment shown in FIG. 2 differs from that previously described only in the construction of the arresting mechanism; for purposes of clarity, similar structure will be identified by similar primed reference numerals, wherein the slide 20 is provided with a cup-shaped cavity 21 and a valve 22 designed for discharging the fluid medium from the cup-shaped cavity 21 as the striker 2' moves into the cavity 21 and admitting fluid medium into the cup-shaped cavity 21 when releasing the striker 2'. The tail portion 3' of the striker 2' has a projection forming a piston 23 whose diameter is equal to that of the cup-shaped cavity 21. For the purpose of opening the check valve 22 at the end of the backward stroke of the striker 2', a cam 24 is provided on the head of the power cylinder 4'. At the required instant said cam 24 acts on the arm 25 of the valve 22, thereby opening the valve to admit the fluid medium into the cup-shaped cavity 21.

The device with an arresting mechanism constructed as described above features a simple design and at the same time provides a higher blow frequency and enhanced dependability in long continuous operation (for example, when tunnelling in highly abrasive hard rock).

The front portion 26 and 26' of the striker, 2', and 2'', respectively (FIGS. 1, 2, 5) is designed for acting on the material at the end of the striker working stroke. In the embodiment illustrated in FIG. 5, the same reference numerals, with double primes attached, will be used to identify components similar to those previously described.

Figure 5:
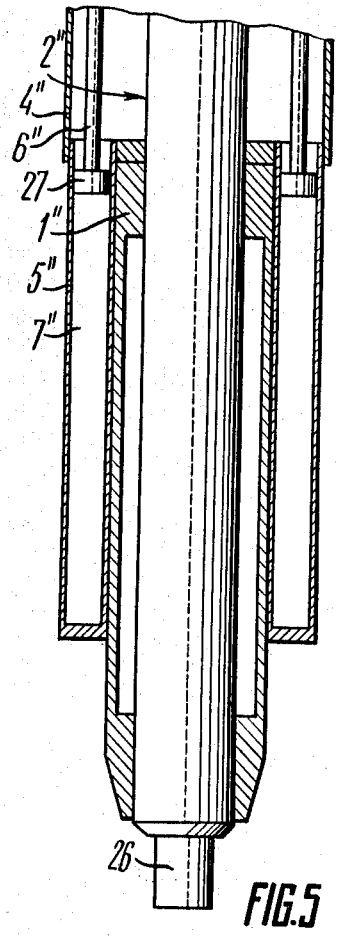
FIG. 5 shows an embodiment of the hydraulic cylinders according to the invention, wherein, as different from the embodiments shown in FIGS. 1 and 2, provision is made of pistons connected to the arresting mechanism by means of the piston rods.

If the pressure source has a relatively low working pressure, use can be made of the embodiment of the striker backward stroke drive shown in FIG. 5. This drive differs from the embodiments described previously in that each hydraulic cylinder 5'' has a piston 27 with a piston rod 6''. This construction makes it possible to somewhat reduce the mass of the device without affecting its performance. As with the embodiment illustrated in FIG. 1, a lower or another space in the cylinder 5'' below piston 27 is periodically put in communication with the pressure source, in order to effect the backward stroke of the arresting mechanism together with the striker, and with a pressure medium exhaust line.

OPERATION

In the embodiment depicted in FIG. 1, the striker 2 is shown substantially at the end of the backward stroke. During the backward stroke, the pressure medium is delivered from the pressure source into the space 7 in the hydraulic cylinders 5, the rods 6 move back, away from the material to be broken, moving the slide 8 in the same direction. The slide 8, by the agency of the detent 9 interacting with the projection 10 on the striker 2, moves the striker tail portion 3 inward in the power cylinder 4. This movement continues until the end of the striker tail portion 3 abuts against the end wall of the cavity 17. After piston 16 enters the cavity 17, during its further movement it forces the fluid medium trapped in the cavity 17 through the check valve 18 into the interior space of the power cylinder 4.

Figure 4:
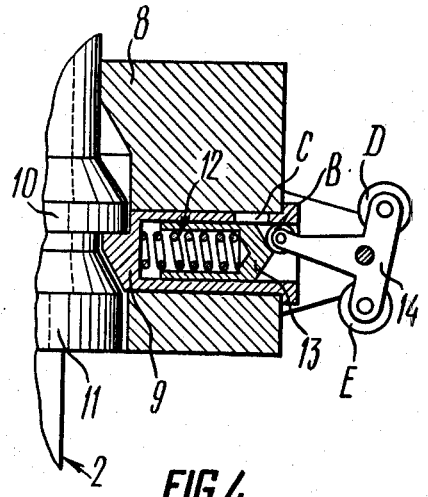
FIG. 4 is an enlarged fragmentary view of the slide with the spring-loaded detent located therein according to the embodiment shown in FIG. 1.

After the striker 2 has stopped as a result of its tail portion 3 abutting against the end wall, the cavity 17 and the space 7 of the hydraulic cylinders 5 are shut off from the pressure source and put in communication with the pressure medium exhaust line. At this instant, under the action of the fluid pressure in the power cylinder 4 the rods 6 begin moving forward, towards the material, carrying the slide 8 therewith. The striker 2 also moves in the same direction, but the speed of its movement is limited by the rate of fluid feed through the throttling element 19 into the cavity 17 closed by the piston 16. The throttling element 19 is designed so as to keep the speed of the striker 2 substantially below the speed of the slide 8. With the slide 8 travelling faster than the striker 2, the bevelled surface of the projection 11 interacts with the bevelled surface of the detent 9, thereby sinking the detent 9 into the slide 8. As soon as the detent 9 is sunk, the roller "B" (FIG. 4) of the triple-arm lever 14 is caused by the bevelled surface of the spring-loaded retainer 13 to engage the port "C" in the detent 9, thereby preventing said detent 9 from moving towards the striker 2.

The striker 2 (FIG. 1) moves further together with the slide 8 until the piston 16 comes out of the cavity 17. As soon as the piston 16 leaves the cavity 17, the striker 2 starts to accelerate under the pressure exerted on the end of the striker tail end 3 by the fluid medium in the power cylinder 4. The striker 2 moves on its working stroke. On accelerating, it strikes the material with its front portion 26 at the end of the stroke and stops.

The slide 8, following the striker 2 at the previous speed, goes past the cam 15 and the latter interacts with the roller "D" (FIGS. 1, 4) due to which the triple-arm lever 14 changes its position, forcing off the retainer 13 through the roller "B" and disengaging said roller "B" from the port "C" in the detent 9. Being free now, the detent 9 is forced by the spring 12 towards the striker 2 and the triple-arm lever 14 does not interfere with the movement of the detent 9 since it is retained in its new position by the other bevelled surface of the retainer 13 acting on the roller "B".

When the slide 8 (FIG. 1) reaches the tail end 3 of the striker 2 and fits onto the piston 16, the action of the beveled surface of the projection 12 sinks the detent 9. After the projection 10 passes, the detent 9 fits into the groove between the projections 10 and 11. At this instant the connections of the space 7 in the hydraulic cylinders 5 are reversed, i.e. the space 7 is shut off from the pressure medium exhaust line and is put in communication with the pressure source. The backward stroke of the striker 2 begins.

Now the striker 2 can be stopped at any point of its backward stroke and held in this position infinitely by shutting off the space 7 in the hydraulic cylinders 5 from the pressure source and locking said space. The backward stroke of the striker 2 can be continued by reopening the communication between the space 7 in the hydraulic cylinders 5 and the pressure source.

During the backward stroke of the striker 2, the slide 8 again passes the cam 15 and the latter, interacting with the roller "E" (FIG. 4), shifts the triple-arm lever 14 into the initial position in readiness for locking the detent 9 when it is sunk at the end of the backward stroke of the striker 2.

Thereafter the operating cycle of the device is repeated as described above.

The analysis of the operation of the device constituting the present invention shows that, with its construction being sufficiently simple, said device provides for retaining the striker at any point of the backward stroke, the arresting mechamism and the drive mechanism are not involved in the working stroke of the striker 2, and the striker 2 is released without acting on the detents of the arresting mechanism. These factors are very beneficial with respect to the dependability of the device.

The embodiment depicted in FIG. 2 is also shown with the striker 2' at the end of the backward stroke. During the backward stroke the space 7' in the hydraulic cylinders 5' is in communication with the pressure source. The action of the pressure medium on the ends of the rods 6' causes the rods 6 to move back, away from the material, carrying the slide 20 with the cup-shaped cavity 21. The pressure of the fluid medium in the power cylinder 4' exerted on the front end of the piston 23 moves said piston together with the striker 2' after the slide 20. This movement continues until the arm 25 of the valve 22 reaches the cam 24 and interacts with the bevelled surface thereof. This interaction opens the valve 22, admitting the fluid medium into the cup-shaped cavity 21. The pressure of the fluid medium on the end of the striker tail portion 3' forces the piston 23 out of the cup-shaped cavity 21. The striker 2' accelerates, moving forward towards the material, thereby making its working stroke. At this instant the space 7' in the hydraulic cylinders 5' is shut off from the pressure source and put in communication with the pressure medium exhaust line. As a result, the rods 6', under the action of the fluid pressure on their ends located in the interior space of the power cylinder 4', move together with the slide 20 after the striker 2' in the forward direction, towards the material.

At the end of the working stroke, the striker 2' strikes the material with its front portion 26' and stops. The slide 20 follows the striker 2', reaches the piston 23 and the cup-shaped cavity 21 fits onto the piston 23. The fluid medium in the cavity 21 becomes slightly more compressed, the fluid pressure opens the valve 22 and the fluid medium issues into the interior space of the power cylinder 4'. After the cup-shaped cavity 21 fits all the way onto the piston 23 on that the end wall of said cavity 21 comes up against the end of the striker tail portion 3', the slide 20 stops and the valve 22 closes.

The stopping of the slide 20 serves as a signal, for instance to an operator, who reverses the connections of the space 7' in the hydraulic cylinders 5', whereby said space 7' is shut off from the pressure medium exhaust line and is put in communication with the pressure source. The action of the pressure medium on the ends of the rods 6' located in the space 7' moves the rods 6 backward, away from the material, carrying the slide 20 therewith. The movement of the slide 20 somewhat increases the volume of the space in the cup-shaped cavity 21 closed by the piston 23. The pressure of the fluid medium in said space drops sharply and becomes substantially less than the fluid pressure in the power cylinder 4'. The pressure of the fluid medium exerted on the front end of the piston 23 causes said piston to move together with the striker 2' after the slide 20. The striker 2 makes its backward stroke. Thereafter the cycle is repeated as described above.

It follows from the abovesaid that this embodiment of the invention has a still simpler construction and the arresting mechanism and the drive do not take part in a blow, the same as in the previous embodiment. Furthermore, this embodiment can operate at a higher blow frequency in virtue of the striker making its downward stroke in a shorter time.

Any of the embodiments described above can also operate with hydraulic cylinders having a piston 27 (FIG. 5), there being no change in the nature of operation.

Thus, the percussive device constituting the present invention features higher dependability than the prior-art devices of a similar scope and possesses a sufficiently high effectiveness in breaking hard and highly abrasive materials, due to which it can find a wide use in multifarious fields of industry.

What is claimed is:

1. A percussive device for transmitting impact pulses, which device comprises:

a housing; a striker having a tail portion, said striker being reciprocatingly supported in said housing and operative to transmit impact impulses to a medium being worked; a power cylinder connected to said housing and accommodating during reciprocation, said tail portion of the striker; means for introducing into said power cylinder a fluid medium under pressure, which fluid medium being capable of storing potential energy when compressed during a backward stroke of said striker and acting upon the end of said striker tail portion during a forward stroke of said striker; an arresting mechanism including means for interacting with said striker during its backward stroke; a striker backward-stroke drive comprising hydraulic cylinders separate from said housing and said power cylinder and spaced radially outward from the axis of said striker, each hydraulic cylinder having an opening formed therein in communication with the power cylinder, a rod in each hydraulic cylinder connected to said arresting mechanism, the relationship between the opening in each hydraulic cylinder, the rods, and the power cylinder being such that said rods move said arresting mechanism into engagement with said striker under the pressure of the fluid medium, each of said hydraulic cylinders being selectively connectable with a pressure source and a pressure medium exhaust line, connection of said hydraulic cylinders with the pressure source effecting a backward stroke of said arresting mechanism jointly with said striker.

2. A percussive device as claimed in claim 1, wherein the striker arresting mechanism is located inside the power cylinder and interacts with the tail portion of the striker, the openings communicating said hydraulic cylinders with the power cylinder being aligned with openings formed in a wall of the power cylinder adjacent the housing, the rods of the hydraulic cylinders extending into the power cylinder through the aligned openings.

3. A percussive device as claimed in claim 1, wherein the arresting mechanism comprises a slide movable in relation to the striker passing therethrough and has a spring-loaded detent engageable with the striker on the backward stroke thereof, the tail portion of the striker having means engageable by said detent for retaining said striker in a start position thereof at the beginning of the forward stroke, the detent being provided with a means for sinking it and locking the same in the slide when retaining the striker.

4. A percussive device as claimed in claim 2, wherein the arresting mechanism comprises a cup-shaped cavity and the tail portion of the striker is provided with a projection which forms a piston adapted to enter said cup-shaped cavity and interact with the surface thereof for effecting the backward stroke of the striker, said arresting mechanism being provided with a valve designed for discharging the fluid medium from the cup-shaped cavity as the striker enters said cavity and for admitting fluid medium into the cup-shaped cavity when releasing the striker.

5. A percussive device for creating impact impulses acting on a medium being worked, which device comprises:

a housing; a striker having a tail portion, said striker being reciprocatingly supported in said housing and creating effects on a medium being worked by impact impulses at the end of its forward motion; a power cylinder connected to said housing and accommodating, during reciprocation, said tail portion of the striker; means for introducing into said power cylinder a compressible fluid medium under pressure, which compressible fluid medium being capable of storing potential energy when compressed during a backward motion of said striker and acting upon the end of said striker tail portion during forward motion of said striker; an arresting mechanism including means for interacting with said striker during its backward motion; a striker backward-motion drive comprising hydraulic cylinders spaced around the periphery of said housing with respect to the axis of said striker, a rod in each hydraulic cylinder dividing the interior of said hydraulic cylinder into two spaces and being connected to said arresting mechanism; means arranged so that one said cylinder space is constantly connected with the interior of said power cylinder for moving said arresting mechanism into engagement with said striker under the pressure of the said compressible fluid medium, and means connectable to a source of pressurized fluid for feeding pressurized fluid to another said space for effecting the backward motion of said arresting mechanism jointly with said striker, and for removing said pressurized fluid out of said another space during the motion of said arresting mechanism into engagement with said striker.

* * * * *